United States Patent [19]

Mourao

[11] Patent Number: 4,549,884

[45] Date of Patent: Oct. 29, 1985

[54] DIESEL OIL CONTAINING MONOALKOXYLATED NONYL PHENOL CHARACTERIZED BY DECREASE IN VISIBLE SMOKE IN EXHAUST GASES

[75] Inventor: Antonio M. Mourao, Fishkill, N.Y.

[73] Assignee: Texaco Inc., White Plains, N.Y.

[21] Appl. No.: 606,083

[22] Filed: May 1, 1984

[51] Int. Cl.[4] ..... C10L 1/18

[52] U.S. Cl. ..... 44/57; 44/78

[58] Field of Search ..... 44/57, 78

[56] References Cited

U.S. PATENT DOCUMENTS 3,615,295 10/1971 Manary, Jr. ..... 44/78

3,927,995 12/1975 Romans ..... 44/78

*Primary Examiner*—Y. Harris-Smith

*Attorney, Agent, or Firm*—Robert A. Kulason; James J. O'Loughlin; Carl G. Seutter

[57] ABSTRACT

Decrease in visible smoke in exhaust gases is achieved by operating diesel engines with fuel containing monoalkoxylated nonyl phenol.

22 Claims, No Drawings

DIESEL OIL CONTAINING MONOALKOXYLATED NONYL PHENOL CHARACTERIZED BY DECREASE IN VISIBLE SMOKE IN EXHAUST GASES

FIELD OF THE INVENTION

This invention relates to middle distillate oils. More particularly it relates to additives which permit combustion of middle distillate hydrocarbon oils under conditions which decrease the amount of visible smoke in the exhaust.

BACKGROUND OF THE INVENTION

As is well known to those skilled in the art, middle distillate fuels typified by diesel oil, fuel oils, kerosene, etc may be burned to produce heat and/or power. It is common for such combustion processes to be characterized by production of undesirably large quantities of smoke due principally to incomplete combustion of hydrocarbon.

In the case of gasoline-burning engines, it may be possible to reduce smoke in the exhaust by use of 250–4000 ppm (0.25%–0.4%) of polyalkoxylated alkyl phenols wherein the molecule contains two or more alkoxy groups, as disclosed in U.S. Pat. No. 3,615,295. See also U.S. Pat. No. 3,876,391.

It is an object of this invention to provide a middle distillate fuel characterized by the ability to burn with decreased production of exhaust smoke. Other objects will be apparent to those skilled in the art.

STATEMENT OF THE INVENTION

In accordance with certain of its aspects, this invention is directed to a middle distillate hydrocarbon composition containing (i) a major portion of a middle distillate hydrocarbon fuel; and (ii) a visible-smoking reducing portion of additive having the formula

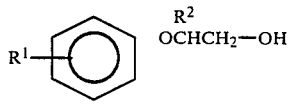

wherein $R^1$ is an alkyl, aralkyl, alkaryl, cycloalkyl, alkenyl, or alkynyl hydrocarbon group; and $R^2$ is hydrogen or an alkyl, aralkyl, alkaryl, cycloalkyl, alkenyl, or alkynyl hydrocarbon group.

DESCRIPTION OF THE INVENTION

The middle distillate fuels which may be employed in practice of the process of this invention may typically include those having an ibp of 300° F.–450° F., say 369° F.; a 50% bp of 400° F.–550° F.; say 496° F.; a 90% bp of 475° F.–625° F., say 586° F.; an EP of 500° F.–650° F., say 627° F.; and an API Gravity of 25–45, say 37.3. These fuels may commonly be labelled as kerosene, fuel oil, diesel oil, No. 1-D, No. 2-D, etc. The preferred middle distillate may be a diesel oil having the following properties;

TABLE

| Property | Value |
|---|---|
| API Gravity D-1298 | 37.3 |
| Kin. Vis. cSt @ 40° C. D-445 | 2.27 |
| Cetane D-613 | 49.6 |

TABLE-continued

| Property | Value |
|---|---|
| Distillation D-86 (°F.) | |
| IBP | 369 |
| 50% | 496 |
| 90% | 586 |
| EP | 627 |

Another preferred charge may be a middle distillate fuel oil having the following typical characteristics.

TABLE

| Property | Value |
|---|---|
| API Gravity D-1298 | 43.0 |
| Kin. Vis. cSt @ 40° C. -D445 | 1.57 |
| Cetane D-613 | 47 |
| Distillation D-86 (°F.) | |
| IBP | 344 |
| 50% | 429 |
| 90% | 490 |
| EP | 524 |

It is a feature of the process of this invention that it may be possible to decrease the visible smoke attained in the exhaust from combustion of these middle distillates by addition thereto of an effective amount (or visible smoke reducing portion) of 0.01–0.4 w%, preferably 0.02–0.04 w%, say 0.2 w% of $R^1C_6H_4OCHR^2CH_2OH$

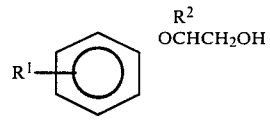

In the above compound, $R^1$ may be a hydrocarbon group selected from the group consisting of alkyl, aralkyl, cycloalkyl, aryl, alkaryl, alkenyl, and alkynyl including such radicals when inertly substituted. When $R^1$ is alkyl, it may typically be methyl, ethyl, n-propyl, iso-propyl, n-butyl, i-butyl, sec-butyl, amyl, octyl, decyl, octadecyl, etc. When $R^1$ is aralkyl, it may typically be benzyl, beta-phenylethyl, etc. When $R^1$ is cycloalkyl, it may typically be cyclohexyl, cycloheptyl, cyclooctyl, 2-methylcycloheptyl, 3-butylcyclohexyl, 3-methylcyclohexyl, etc. When $R^1$ is aryl, it may typically be phenyl, naphthyl, etc. When $R^1$ is alkaryl, it may typically be tolyl, xylyl, etc. When $R^1$ is alkenyl, it may typically be vinyl, allyl, 1-butenyl, etc. When $R^1$ is alkynyl, it may typically be ethynyl, propynyl, butynyl, etc. $R^1$ may be inertly substituted i.e. it may bear a non-reactive substituent such as alkyl, aryl, cycloalkyl, ether, halogen, nitro, etc. Typically inertly substituted $R^1$ groups may include 3-chloropropyl, 2-ethoxyethyl, carboethoxymethyl, 4-methylcyclohexyl, p-chlorophenyl, p-chlorobenzyl, 3-chloro-5-methylphenyl, etc. The preferred $R^1$ groups may be lower alkyl, i.e. $C_4$–$C_{10}$ alkyl, groups including eg butyls, amyls, hexyls, octyls, decyls, etc. $R^1$ may preferably be nonyl.

In the above compound, $R^2$ may be hydrogen or a hydrocarbon group selected from the group consisting of alkyl, aralkyl, alkaryl, cycloalkyl, aryl, alkenyl, and alkynyl including such radicals when cycloalkyl inertly substituted. When $R^2$ is alkyl, it may typically be methyl, ethyl, n-propyl, iso-propyl, n-butyl, i-butyl, sec-butyl, amyl, octyl, decyl, octadecyl, etc. When $R^2$ is aralkyl, it may typically be benzyl, beta-phenylethyl, etc. When $R^2$ is cycloalkyl, it may typically be cyclohexyl, cycloheptyl, cyclooctyl, 2-methylcycloheptyl, 3-butylcyclohexyl, 3-methylcyclohexyl, etc. When $R^2$ is aryl, it may typically be phenyl, naphthyl, etc. When $R^2$ is alkaryl, it may typically be tolyl, xylyl, etc. When $R^2$ is alkenyl, it may typically be vinyl, allyl, 1-butenyl, etc. When $R^2$ is alkynyl, it may typically be ethynyl, propynyl, butynyl, etc. $R^2$ may be inertly substituted i.e. it may bear a non-reactive substituent such as alkyl, aryl, cycloalkyl, ether, halogen, nitro, etc. Typically inertly substituted R groups may include 3-chloropropyl, 2-ethoxyethyl, carboethoxymethyl, 4-methyl cyclohexyl, p-chlorophenyl, p-chlorobenzyl, 3-chloro-5-methylphenyl, etc. The preferred $R^2$ groups may be hydrogen or lower alkyl, i.e. $C_1$–$C_5$ alkyl, groups including eg methyl, ethyl, n-propyl, i-propyl, butyls, amyls, etc. $R^2$ may preferably be hydrogen or methyl.

Additives which may be employed in practice of this invention may include the following:

TABLE

| |
|---|
| $C_9H_{19}—C_6H_4—OCH_2CH_2OH$ |
| $C_9H_{19}—C_6H_4—OCH(CH_3)CH_2OH$ |
| $C_8H_{17}—C_6H_4—O(CH_2CH_2O)_4H$ |
| $C_6H_{13}—C_6H_4—O(CH_2CH_2O)_6H$ |
| $C_{10}H_{21}—C_6H_4—O(CH_2CH_2O)_{20}H$ |

The first listed of these additives may be preferred for use in diesel oil.

These materials may be commercially available: Illustrative commercial formulations may include the Surfonic N-10 brand of nonyl monoethoxyphenol having an HLB value of 3.4.

Smoke emission is determined in the Visible Smoke Reduction Test (VSRT) in a standard 1980 Oldsmobile Delta 88 Diesel Engine operating at constant speed (1240 RPM=40 MPH), steady state conditions. During a fuel evaluation, engine operation proceeds from a very low load condition (BMEP=10) to a very high load condition (BMEP=100).

The fuel is rated based upon the fuel rate at which the Base Fuel first shows visible smoke. The VSRT rating is the percentage by which the opacity of the experimental fuel is lower than that of the Base Fuel at the fuel rate. A negative rating means that the opacity of the experimental fuel exhaust is undesirably higher than that of the Base Fuel.

It is found that diesel fuels containing 0.01 w%–0.4 w%, say 0.02 w% of additive reduce the amount of smoke in the exhaust gases by a substantial factor. At the fuel rate which first shows a visible smoke with a standard or base fuel, the smoke opacity rating may be 15%–20% lower than when using the additives of this invention i.e. it is possible to operate at 4.3 BMEP higher when using the process of this invention than when using base fuel—before the exhaust shows visible smoke.

In the Brake Mean Effective Power (BMEP Rating, the increase in power (against the standard fuel containing no additive) is measured at the maximum power output without visible smoke. The BMEP Rating is the percentage by which the BMEP of the experimental fuel is higher than that of the Base Fuel at the fuel rate at which visible smoke is observed.

Illustrative formulations which may be employed in practice of this invention may include the following:

TABLE

I. 0.02 w % Surfonic N-10 brand of nonyl monoethoxyphenol in a diesel fuel having the following properties:

| Property | Value |
|---|---|
| API Gravity D-1298 | 37.3 |
| Kin. Vis. cSt @ 40° C. D-445 | 2.27 |
| Cetane D-613 | 49.6 |
| Distillation - D-86 °F. | |
| IBP | 369 |
| 50% | 496 |
| 90% | 586 |
| EP | 627 |

II. 0.02 w % Surfonic N-10 brand of nonyl monoethoxyphenol in a No 2 fuel oil having the following properties:

| Property | Value |
|---|---|
| API Gravity D-1298 | 35.7 |
| Kin. Vis. cSt @ 40° C. D-445 | 2.40 |
| Cetane D-613 | 44.7 |
| Distillation - D-86 °F. | |
| IBP | 388 |
| 50% | 510 |
| 90% | 596 |
| EP | 653 |

III. 0.1 w % Surfonic N-10 brand of nonyl monoethoxyphenol in a kerosene having the following properties:

| Property | Value |
|---|---|
| API Gravity D-1298 | 43.0 |
| Kin. Vis. cSt @ 40° C. D-445 | 1.57 |
| Cetane D-613 | 47 |
| Distillation - D-86 °F. | |
| IBP | 344 |
| 50% | 429 |
| 90% | 490 |
| EP | 524 |

IV. 0.03 w % Surfonic N-10 Brand of nonyl monoethoxyphenol in a diesel fuel having the following properties:

| Property | Value |
|---|---|
| API Gravity D-1298 | 32.8 |
| Kin. Vis. cSt @ 40° C. D-445 | 2.22 |
| Cetane D-613 | 42.2 |
| Distillation - D-86 °F. | |
| IBP | 356 |
| 50% | 495 |
| 90% | 610 |
| EP | 640 |

DESCRIPTION OF SPECIFIC EMBODIMENTS

Practice of this invention will be apparent to those skilled in the art from the following wherein, as elsewhere in this specification, all parts are parts by weight unless otherwise set forth.

EXAMPLE I

In this Example which represents the best mode presently known of carrying out this invention, the diesel fuel composition I of the above Table containing 0.02 w% of the Surfonic N-10 brand of nonyl mono-ethoxyphenol was tested in the Visible Smoke Reduction Test VSRT. At the fuel rate which gives visible smoke with base fuel, the smoke capacity rating was 14.6% lower when the fuel contained 0.02 w% of the Surfonic N-10 brand of nonyl monoethoxyphenol. This allowed the engine to attain a 4.3% higher BMEP without emitting visible smoke.

EXAMPLE II

In each of the following Examples, additive was added to the Base Fuel diesel fuel and the combination was evaluated. The VSRT column indicates the % visible smoke reduction at the fuel rate which gives visible smoke with base fuel. A minus sign indicates that the smoke increased. The BMEP column indicates the % improvement (in terms of increase in power) attained without visible smoke.

TABLE

| Example | Additive Conc. w % | Additive | VSRT | BMEP |
|---|---|---|---|---|
| I | 0.02 | Surfonic N-10 brand of nonyl monoethoxyphenol | 14.6 | 4.3 |
| II | 0.04 | Surfonic N-10 brand of nonyl monoethoxyphenol | 3.6 | 0.8 |
| III* | 0.02 | Surfonic N-40 brand of nonyl tetraethoxy phenol | 5.6 | 2.1 |
| IV* | 0.02 | Surfonic N-200 brand of nonyl eicosa ethoxy phenol | −7.7 | −2.2 |
| V* | 0.04 | Surfonic N-200 brand of nonyl eicosa ethoxy phenol | 1.5 | −0.4 |
| VI* | 0.02 | Ethyl MPA-D brand of polyethoxylated alkyl phenol | 7.2 | 2.1 |
| VII* | 0.04 | Ethyl MPA-D brand of polyethoxylated alkyl phenol | 2.1 | 0.9 |
| VIII* | 0 | Base Oil Alone | — | — |

*control examples falling outside the scope of this invention.

From the above Table, the following conclusions may be drawn:

(i) Practice of the instant invention permits attainment of as much as ten times (14.6/1.5) as much improvement in visible smoke reduction i.e. it is possible to operate at a fuel rate which is about 4.3% higher than that of the control before visible smoke is first noted;

(ii) substantially greater improvement in the VSRT is observed by practice of the instant invention (Example I) than is obtained in control Examples III*-VII*;

(iii) It is possible to increase the power (BMEP) by as much as 4.3% without production of visible smoke; and (iv) the additives having a single alkoxy group are more active. Comparison of Example I with Example III* shows that at the same concentration, the VSRT is increased by a factor of almost 3 (14.6/5.6) and the BMEP is increased by a factor of more than 2 (4.3/2.1).

Results comparable to those of Example II may be attained by use of the following additives within the scope of this invention.

TABLE

| Example | Additive Conc. w % | Additive |
|---|---|---|
| IX | 0.2 | $C_9H_{19}-C_6H_4O(CH_2CH_2CH_2O)H$ |
| X | 0.2 | $C_9H_{19}-C_6H_4O(CH_2\overset{\overset{CH_3}{\vert}}{C}H-O)H$ |
| XI | 0.2 | $C_9H_{19}-C_6H_4O(CH_2\underset{\underset{CH_3}{\vert}}{\overset{\overset{CH_3}{\vert}}{C}}O)H$ |
| XII | 0.2 | $C_9H_{19}-C_6H_4O(CH_2-\underset{\underset{CH_3}{\vert}}{\overset{\overset{CH_3}{\vert}}{C}}HCHO)H$ |

Although this invention has been illustrated by reference to specific embodiments, it will be apparent to those skilled in the art that various changes and modifications may be made which clearly fall within the scope of this invention.

What is claimed is:

1. A liquid middle distillate fuel composition comprising (i) a major portion of a liquid middle distillate hydrocarbon fuel; and (ii) a visible-smoke reducing portion of additive having the formula

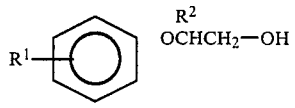

wherein $R^1$ is an alkyl, aralkyl, alkaryl, cycloalkyl, alkenyl, or alkynyl hydrocarbon group; and $R^2$ is hydrogen or an alkyl, aralkyl, alkaryl, cycloalkyl, alkenyl, or alkynyl hydrocarbon group.

2. A liquid middle distillate fuel composition as claimed in claim 1 wherein $R^1$ is an alkyl group.

3. A liquid middle distillate fuel composition as claimed in claim 1 wherein $R^1$ is a $C_4$–$C_{20}$ alkyl hydrocarbon group.

4. A liquid middle distillate fuel composition as claimed in claim 1 wherein $R^1$ is a $C_9$ alkyl hydrocarbon group.

5. A liquid middle distillate fuel composition as claimed in claim 1 wherein $R^2$ is hydrogen.

6. A liquid middle distillate fuel composition as claimed in claim 1 wherein $R^2$ is methyl.

7. A liquid middle distillate fuel composition as claimed in claim 1 wherein said additive has the formula

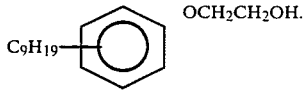

8. A liquid middle distillate fuel composition comprising (i) a major portion of a liquid middle distillate hydrocarbon fuel; and (ii) a visible-smoke reducing portion of, as additive, a mono alkylated alkyl phenol.

9. A middle distillate fuel composition as claimed in claim 8 wherein said liquid middle distillate hydrocarbon is a diesel oil.

10. A middle distillate fuel composition as claimed in claim 8 wherein said liquid middle distillate hydrocarbon is a kerosene.

11. A middle distillate fuel composition as claimed in claim 8 wherein said liquid middle distillate hydrocarbon is a fuel oil.

12. A liquid middle distillate fuel composition as claimed in claim 8 wherein said additive is a monoethoxylated alkyl phenol.

13. A liquid middle distillate fuel composition as claimed in claim 8 wherein said additive is a monopropoxylated alkyl phenol.

14. A liquid middle distillate fuel composition as claimed in claim 8 wherein said additive is a monoalkoxylated $C_1$–$C_{20}$ alkyl phenol.

15. A liquid middle distillate fuel composition as claimed in claim 8 wherein said additive is a monoalkoxylated $C_4$–$C_{12}$ alkyl phenol.

16. A liquid middle distillate fuel composition as claimed in claim 8 wherein said additive is a monoethoxylated $C_4$–$C_{12}$ alkyl phenol.

17. A liquid middle distillate fuel composition as claimed in claim 8 wherein said additive is a monoethoxylated nonyl phenol.

18. A liquid middle distillate fuel composition as claimed in claim 8 wherein said additive is present in amount of 0.01–0.4 w% of said fuel composition.

19. A diesel fuel composition comprising (i) a major portion of a diesel fuel oil; and (ii) a visible-smoke reducing portion of 0.01–0.4 w% of as additive monoethoxyl nonyl phenol.

20. The method of reducing the smoke emission from a internal combustion, compression ignition engine which comprises operating said internal combustion compression ignition engine with a diesel fuel composition comprising (i) a major portion of a liquid middle distillate hydrocarbon fuel; and (ii) a visible-smoke reducing portion of additive having the formula

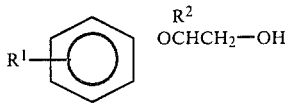

wherein $R^1$ is an alkyl, aralkyl, alkaryl, cycloalkyl, alkenyl, or alkynyl hydrocarbon group; and $R^2$ is hydrogen or an alkyl, aralkyl, alkaryl, cycloalkyl, alkenyl, or alkynyl hydrocarbon group.

21. The method of treating a liquid middle distillate fuel composition to obtain a product characterized by the ability to be utilized as fuel in an internal combustion engine with reduced smoke emission which comprises adding to a major portion of a liquid middle distillate hydrocarbon fuel a visible-smoke reducing portion of 0.01–0.4 w% of a visible-smoke reducing additive consisting essentially of a monoethoxy phenol having the formula

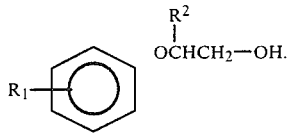

22. The method of treating a liquid middle distillate fuel composition to obtain a product characterized by the ability to be utilized as fuel in an internal combustion engine with reduced smoke emission as claimed in claim 21 wherein said phenol is monoethoxy $C_4$–$C_{12}$ alkylphenol.

* * * * *